US007049621B2

(12) United States Patent
Bassi

(10) Patent No.: US 7,049,621 B2
(45) Date of Patent: May 23, 2006

(54) APPARATUS AND METHOD FOR DETECTING THE ORIENTATION OF TEXTILE PRODUCTS SUCH AS STOCKINGS AND SOCKS

(75) Inventor: Gino Bassi, Bologna (IT)

(73) Assignee: Matec S.p.A., Scandicci (IT)

( * ) Notice: Subject to any disclaimer, the term of this patent is extended or adjusted under 35 U.S.C. 154(b) by 334 days.

(21) Appl. No.: 10/452,649

(22) Filed: Jun. 2, 2003

(65) Prior Publication Data

US 2003/0230734 A1 Dec. 18, 2003

(30) Foreign Application Priority Data

Jun. 18, 2002 (IT) ..... FI2002A0106

(51) Int. Cl.
*G01V 5/00* (2006.01)
*G01V 5/04* (2006.01)

(52) U.S. Cl. ..... 250/559.4; 209/577

(58) Field of Classification Search ..... 250/223 R, 250/559.4, 231.14–231.18, 559.26; 209/571, 209/576, 577, 587, 588; 223/75, 112; 112/470.15, 112/DIG. 2, DIG. 3; 356/634, 908, 459
See application file for complete search history.

(56) References Cited

U.S. PATENT DOCUMENTS 4,799,613 A * 1/1989 Adamson ..... 223/39
5,373,363 A * 12/1994 Kobayashi ..... 356/634
5,456,392 A * 10/1995 Majors ..... 223/112
5,544,603 A * 8/1996 Bell et al. ..... 112/475.12
5,771,830 A * 6/1998 Hodges ..... 112/470.15
5,884,822 A * 3/1999 Migliorini ..... 223/1
6,155,466 A * 12/2000 Migliorini ..... 223/77
6,158,367 A * 12/2000 Jordan et al. ..... 112/470.08
6,276,577 B1 * 8/2001 Migliorini ..... 223/112
6,516,979 B1 * 2/2003 Migliorini ..... 223/75
6,719,177 B1 * 4/2004 Manini ..... 223/75
2004/0108343 A1 * 6/2004 Bagni ..... 223/75
2004/0155074 A1 * 8/2004 Jordan et al. ..... 223/112

FOREIGN PATENT DOCUMENTS

EP 0 521 206 A1 1/1993
EP 1 178 143 A2 2/2002
EP 1 203 839 A1 5/2002
IT PI/2000/A/27 4/2000
IT PI/2001/A/22 3/2001

* cited by examiner

*Primary Examiner*—David Porta
*Assistant Examiner*—Davienne Monbleau
(74) *Attorney, Agent, or Firm*—McGlew and Tuttle, P.C.

(57) ABSTRACT

The orientation of textile articles such as stockings and socks having closed or open toe are detected by a method and apparatus, in a plant for the automatic treatment of articles in which the articles are pneumatically moved. A machine (6) requires the articles to arrive in a predetermined orientation, that is, presented with either their toe or opposite portion thereof facing the machine (6). Upstream of machine (6) is a removal device (2) able to pick up one or more articles from a container (1) in which the article are disposed in bulk. The apparatus and method are between removal device (2) and machine (6). A tubular chamber (30) is provided with an input/output section (300) for the articles. A fixed pin (31) is disposed centrally within the chamber (30) and substantially coaxial thereto. The articles are fitted onto the pin 30. A detection device (37) detects the presence of an article fitted onto the pin (31).

11 Claims, 4 Drawing Sheets

APPARATUS AND METHOD FOR DETECTING THE ORIENTATION OF TEXTILE PRODUCTS SUCH AS STOCKINGS AND SOCKS

FIELD OF THE INVENTION

The present invention refers to an apparatus and a method for detecting articles such as stockings or stocks.

BACKGROUND OF THE INVENTION

The present invention makes it possible to fully automate the process of loading articles such as stockings and socks, with their toe being either closed or open, onto the shapes of an ironing machine, or other machine or equipment, with the articles being oriented in a predetermined way.

SUMMARY OF THE INVENTION

This result has been achieved, according to the invention, by adopting the idea of making an apparatus having a removal device able to pick up one article from a container in a random longitudinal orientation. A pneumatic system moves the article from the removal device to a tubular chamber with an input/output section. A fixed pin is arranged centrally within the chamber. The pin is of a size so that only one end of articles may fit substantially coaxial thereto. A detector detects a presence of the article fitted onto the pin. A reversing device able to reverse the orientation of the articles is arranged downstream of the chamber. A downstream machine requiring the articles in only one longitudinal orientation is also arranged downstream of the chamber. The pneumatic system moves the article from the removal device to the tubular chamber to the fixed pin. The pneumatic system then selectively moves the article from the tubular chamber to either of the reversing device and the downstream location.

The present invention makes it possible to automatically operate the removal of stockings and stocks having closed or open toes from a container wherein they are disposed in bulk. The orientation of the articles and subsequent loading onto shapes of a ironing machine or other machines and equipment can be performed in a predetermined way. Moreover, an apparatus according to the invention is relatively simple to make, cost-effective and reliable even after a prolonged service life.

These and other advantages and characteristics of the invention will be best understood by a reading of the following description in conjunction with the attached drawings given as a practical exemplification of the invention, but not to be considered in a limitative sense.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
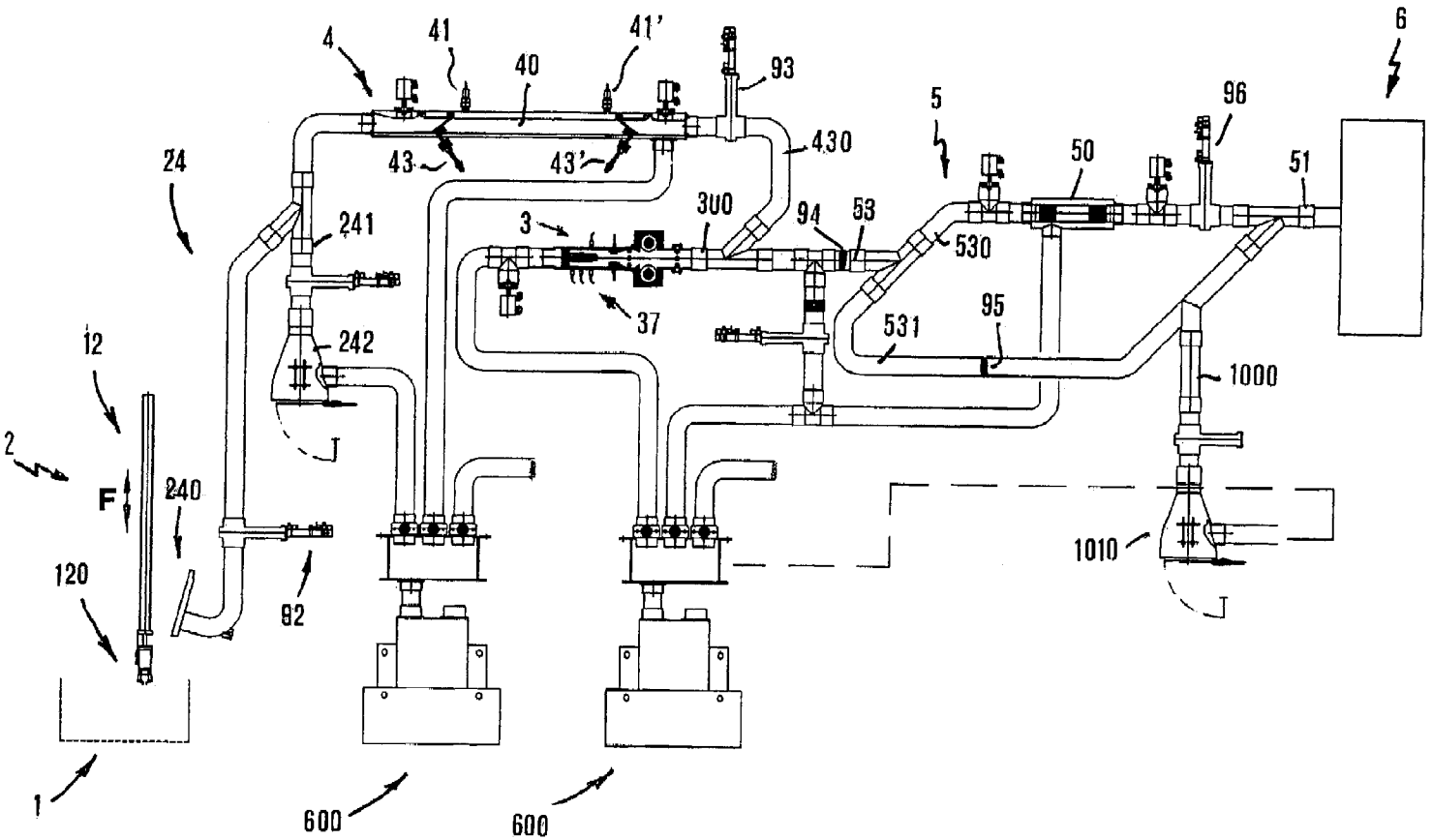
FIG. 1 is a simplified diagram of a plant comprising an apparatus according to the invention.

According to the example shown in FIG. 1, an apparatus in compliance with the invention can be used in a plant for the automatic treatment of articles such as stocking, socks and the like. The automatic treatment can be the removal thereof from a container 1 wherein the articles are disposed in bulk, the detection of their orientation after the removal from the container 1, the reversal, as necessary, of the orientation, and finally the discharge thereof in a condition of predetermined orientation. Downstream of the outlet for the discharge of the articles, provision may be made for a machine of a kind to be supplied with the articles oriented in a predetermined way.

The plant in question comprises means 2 for removing the articles from the container 1 and transferring them from the container 1 to the detection device 3 in correspondence of which the orientation thereof is revealed (as best described later on). Between the means 2 for the removal of articles from the container 1 and the detection apparatus 3, so called "single-handling" means 4 are provided from which one article at a time would come out even if the means 2 should remove more than one article. Downstream of the detection apparatus 3 means are provided for reversing the orientation of the article should such orientation be different from the wanted one. When exiting from means 5 each article is oriented as desired, that is, in a predetermined direction. Two aspirators 600 are provided to create pneumatic flows having a function to be described later.

For example, the means 2 for removing the articles from the container 1 may be of a type disclosed in the Patent No. (IT) PI/2001/A/22, that is, of a type comprising a gripper 120 mounted on the lower end of a support having vertical axis 12 and movable from, and to, the container 1 as indicated by the double arrow "F". The gripper 120 is of a type with normally open jaws which are closed under control of sensor means (solid to the gripper's body) when the gripper 120 comes in proximity of the heap formed by the articles present in the container 1. To operate the removal of one article from the container 1, the support 12 is moved down so as to bring the gripper 120 close to the heap of articles. When the sensor means detect the closeness of gripper 120 to the heap of articles, they operate the closing of the relevant jaws which, in this way, seize one or more articles of the heap. In the subsequent step for lifting the support 12, the articles hanging from the gripper 120 are moved to the inlet section or mouth 240 of a pipe 24 which leads into the single-handling device 4. By deactivating the gripper 120 to open its jaws, and thus releasing the articles previously seized, and then activating suction within the pipe 24 (for example, by means of a valve 91 provided on the pipe), there is obtained the transfer of the articles from the gripper 120 to the single-handling device 4. The latter, for example, may be of a type including a tubular chamber 40 wherein optical photocell means 41, 41' are disposed to act respectively downstream or upstream of relevant movable gates 42, 42' for detecting the presence of articles in correspondence thereof. The gates 42, 42' are associated with corresponding actuators (not shown in the drawings) and are positioned within the chamber 40 to obstruct (when lowered) and to release (when lifted) the inlet (I) and outlet (U) sections, respectively. In correspondence of the lower edge of each gate 42, 42', a rod of a corresponding stationary cylinder 43, 43' is made to act. The rod of each cylinder 43, 43' being positioned for going through a corresponding hole formed in the outside wall of chamber 40. When the means 2 hand the articles over to the tube 24 as previously described, the gate 42 is lifted and gate 42' lowered, the rods of cylinders 43, 43' being both retracted. The disposition of the articles within the chamber 40 having thus taken place, the rod of the cylinder 43' is withdrawn to such an extent as to bring the respective free end in correspondence of the gate 42', thereby blocking the articles's fabric between the tip of the rod and the gate's wall. During this step, the suction within the chamber 40 is maintained in the direction of outlet (U). Subsequently, the suction is reversed so that, if more articles are introduced into the chamber 40, all of them which are not blocked, as previously described, transit again through the section (I) of chamber 40 and are brought back into the container 1 via a discharge branch 241 of conduit 24 (which branch will be opened beforehand in correspondence of a gate 92, at the end of which there is located a discharge manifold or "pot" 242 known per se. Upon completion of the discharge of extra articles, that is, articles not blocked by the rod of cylinder 43' and gate 42', the gate 42 is lowered and the rod of cylinder 43' is withdrawn so that the article previously blocked by the latter is released and moves up to the gate 42. At this point, the rod of cylinder 43 is drawn out for blocking the article at the gate 42, the gate 42' is lifted and the suction is started in direction of outlet (U), after which, the thus stretched article is released by retracting the rod of cylinder 43.

The "single-handling" procedure above described, and known per se to those skilled in the art, allows only one article, in stretched condition, to come out from the chamber 40, even if the means 2 should remove more than one article from the container 1.

The outlet suction (U) of chamber 40 is connected with the device 3, for detecting the articles' orientation, through a conduit 430 on which a gate 93 is disposed.

The device 3 comprises a tubular chamber 30 with only one suction 300 for articles' inlet/outlet, and includes a fixed central pin 31 disposed along the respective longitudinal axis x—x. The pin 31 has a shape substantially cylindrical with a rounded tip 310 and is fixed to a support base 32 provided with longitudinal through holes 320. Provided between the pin 31 and the articles' inlet/outlet section is a convergent-divergent conduit 33. Provided in correspondence of the articles' inlet/outlet section is a pair of motor-driven rollers 34 arranged in a facing relationship. The rollers 34 are carried by the end of respective arms 340 onto which relevant actuators 341 are made to act. The actuators are engaged with fixed parts 345 of the machine, and make it possible to change the distance between two rollers 34. The rollers 34 are kinematically connected to a motor member 344 via a belt 343 and a plurality of transmission pulleys 342. The belt 343 and pulleys 342 are arranged to transmit motion from the motor 344 to the rollers 34 during the displacement of the rollers when they move close to or away from each other under control of the actuators 341 acting directly on arms 340.

Figure 2:
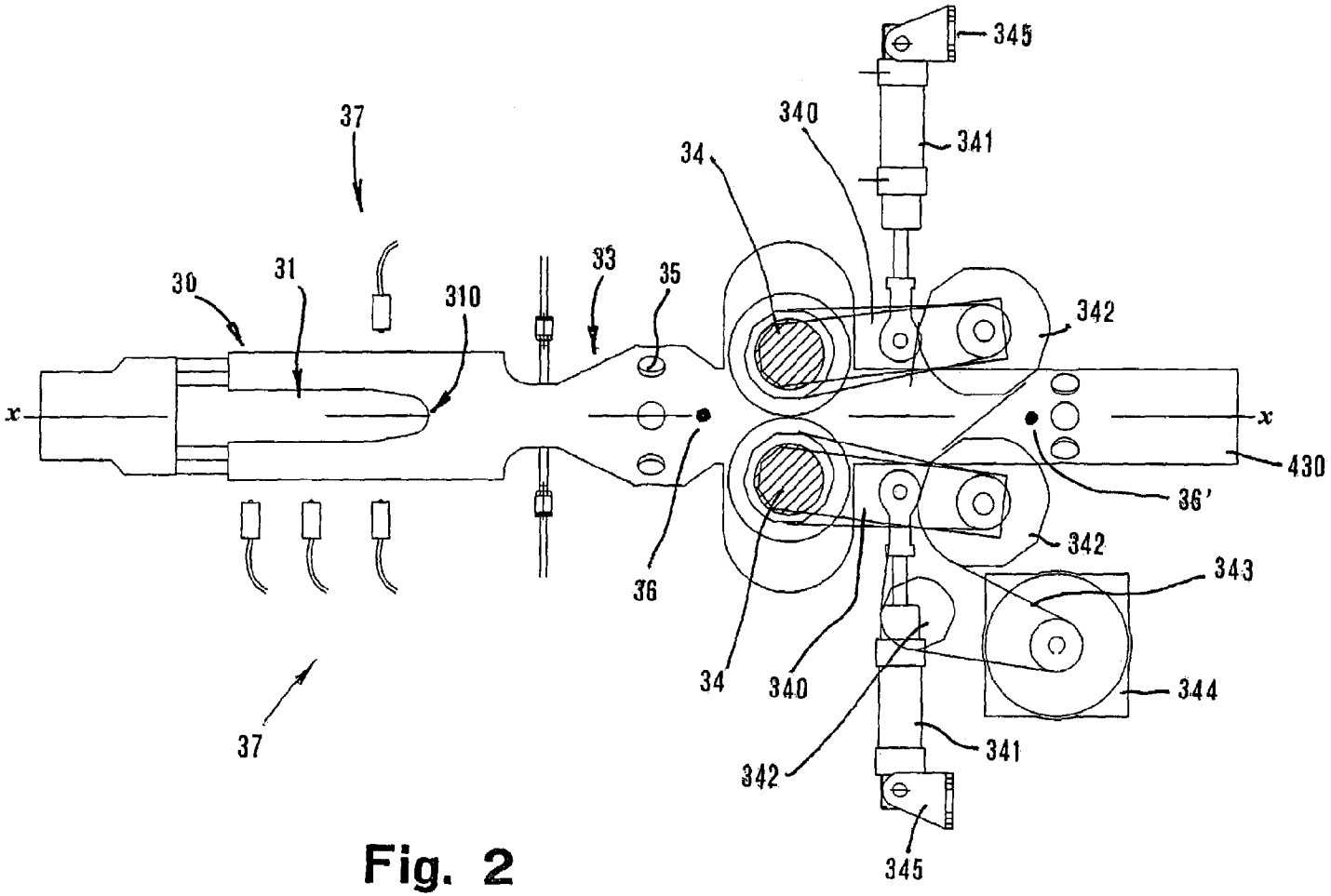
FIG. 2 is a schematic longitudinal view of an apparatus according to the invention.
Figure 3:
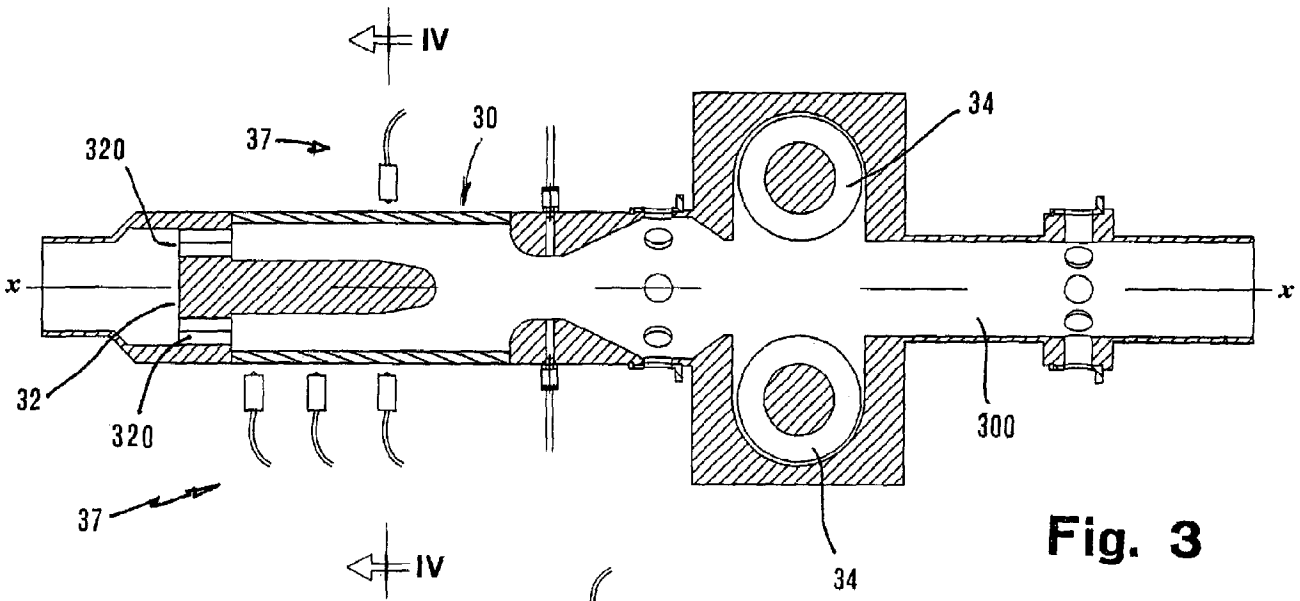
FIG. 3 is a view in longitudinal section of the apparatus of FIG. 2, with some parts omitted for a clearer representation of others.
Figure 4:
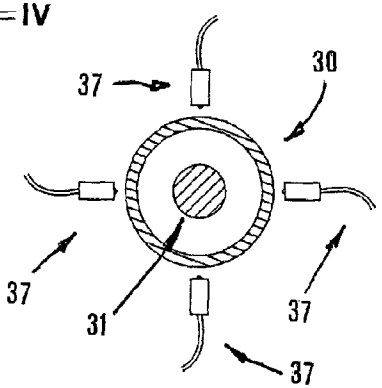
FIG. 4 is a cross-sectional view of the exemplary embodiment of the apparatus shown in FIG. 3, taken on line IV—IV.
Figure 6:
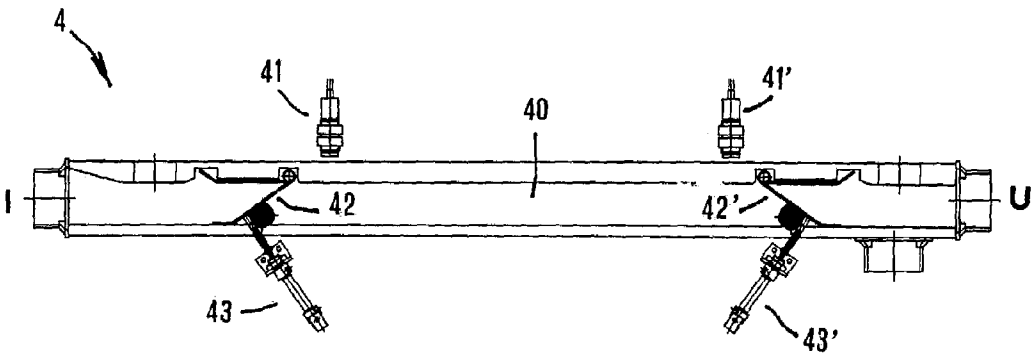
FIG. 6 shows an enlarged detail of FIG. 1.

Moreover, the chamber 30 has a plurality of radial through holes 35 in correspondence of a section located between the rollers 34 and the conduit 33. Disposed upstream and respectively downstream of rollers 34 (that is, to the right and to the left, in the drawing of FIG. 2) are two photocells or groups of photocells 36', 36 whose optical axes are pointed towards the longitudinal axis x—x of the chamber 30.

An article entering the device 3 is detected by the photocells 36' which start the cylinders/actuators 314, the latter bringing the rollers 34 close to each other. Advantageously, the rollers 34 are slotted so as not to block the air flow in case their respective cylindrical surfaces are in contact with each other. Concurrently, the motor 344 is started to drive rollers 34 into rotation. The article is therefore compressed between the rollers 34, which causes it to move downstream, that is, towards the convergent-divergent conduit 33. If the article (stocking or sock with closed toe) comes up by being oriented with the portion of the hem or elastic edge downstream, that is, with the un-sewn portion turned forwards with respect to the direction of the introduction thereof into the chamber 30, the transit of the article through the conduit 33 is disposed in open configuration, that is, the mouth defined by the open portion of the hem or elastic edge opens up and fits onto the pin 31. A measuring device is provided on the roller 34, to evaluate the length of the portion of the article passing through the rollers 34. In practice, provision may be made for a device which determines, based on the number of revolutions or steps made by the rollers and the diameter thereof, the extent of the article passing through the rollers 34. The reading of the meter may, advantageously, be related to the detections of the photocells 36, 36'.

If the article on input to the device 3 comes up with its toe facing the pin 31 and, during its advancement, turns itself inside out, then the data evaluated by counting the steps made by the rollers 34 is greater than the corresponding to the case when the article, by presenting itself with the hem facing the pin 31, fits onto the latter. The count value corresponding to the latter case is a known and preset value ($n_{ref}$) with which the value (n) detected each time through the count of the steps made by the rollers 34 is compared. If $n_{ref}>n$, then there is assumed that the article results with the toe facing the pin 31, that is, turned inside out or not fitted onto the same. In this circumstance, by reversing the motion of rollers 34 it is possible either to bring the article back in correspondence of the inlet section of the device 3, in order to repeat the same operation at least once, or to assume that the article is oriented with the toe facing the pin 34.

Moreover, provision is made for a plurality of photocells 37 disposed in correspondence of chamber 30 and oriented towards the pin 31. The photocells 37 are able to intercept (all together) the article when this is fitted onto the pin 31, that is, when the article is oriented with the portion of elastic hem facing the base 32 of pin 31.

In case the article comes up with the elastic portion forwards, the elastic portion will be the first to move through the conduit 33 and arrive at the chamber 30. The conduit 33 will cause the opening or stretching apart of the article, and the elastic portion thereof will begin to be fitted onto the pin 31. For this reason, the article will continue its travels downstream, that is, towards the base 32 of the pin 31, and be intercepted by the photocells 37.

On the contrary, in case of an article coming up with its toe forwards, the latter will not be able to be fitted onto the pin 31. For this reason, the toe will, in its travel towards the pin 31, be arranged fully sideways of the pin 31. The relevant interception of the article by one photocell 37 or only by some photocells 37, but not by all of them,—a detection to be combined with the result of the count of steps of rollers as previously described—corresponds to the identification of the orientation of an article with its toe forwards. The article oriented with the toe forwards might also remain resting on the distal end 310 of the pin 31 and, in this case, the signal revealing the article with its toe forwards would be given by a lack of interception by all the photocells 37.

Once the article's orientation has been identified, the same article is released. For this operation, the rollers 34 are moved away from each other, and a suction is started which causes the exit of the article, the relative orientation of which begin thus known.

Mounted downstream of the device 3 is a pneumatic circuit 5 for the possible reversal of articles' orientation. According to the example of FIG. 1, the circuit 5 comprises a conduit 53 connected with the input/output section of the device 3 and subdivided downstream into an upper branch 530 and a lower branch 531. Provided on the conduit 53 is a relevant gate 94. Mounted in series on the upper branch 530 is an anti-twist device 50 known per se. Downstream of the anti-twist device 50 is the discharge 51 of the articles, which are taken to a final working station 6 wherein an ironing machine or the like, is made to operate.

The outlet of the lower branch, which bypasses the device 50, is in correspondence of the discharge 51.

If the articles arrive at the downstream machine 6 all having their elastic or hem forwards, those articles so oriented upon exiting the device 3, are caused to transit through the upper branch 530 as far as the machine 6. On the contrary, those articles having their toe forwards, are made to reverse their orientation within the circuit 5. In this case, the articles will transit along the upper branch 530 as far as the gate 96 provided on the upper branch 530 downstream of the anti-twist device 50 and disposed, in this case, in a closed configuration. At this point, the gate 94 of conduit 53 will be closed and, by a suction, the article will be made to transit—this time in a direction opposite to the previous one—through the same portion of upper branch 530 and arrive at the lower branch 531. In the lower branch 531 there is provided a further gate 95, which will be open to allow the passage of the articles as far as the outlet section 51, which coincides with the inlet section of the machine 6.

Described hereunder is a possible example of operation of the device, according to the invention, in conjunction with the plant where it can be disposed.

At least one article (not shown in the drawings) is removed out of container 1 by means of the gripper 120. One or more articles are then lifted in correspondence of section 240 and are subjected to a suction which makes them enter the tube 24. The tube 24 then takes the at least one article up to the single-handling device 4. On output from the single-handling device 4 only one article will be present within the conduit 430. This article will arrive at the device 3 which will detect the orientation thereof in a manner similar to that previously described. In practice, the article arriving through the conduit 430 is detected by the photocell 36', thereby determining the double activation of rollers 34. In particular, the rollers 34 are both moved close to each other by operation of actuators 341, as well as being driven into rotation by the operation of motor 344.

The article in transit through the rollers 34 is taken to the chamber 30 where, if it is oriented with the elastic portion forwards, the article is able to fit onto the pin 31. This condition being revealed by all the photocells 37. Otherwise, it is assumed that the article is oriented with its toe forward, that is, facing the pin 31. Therefore upon exit from the device 3, the system is able to know the orientation of the articles as they are gradually removed and, as a function of the actual orientation, to carry out or not the reversal of orientation of the articles within the circuit 5, prior to feeding the articles to the machine 6 located downstream.

The machine 6 may be, for example, an ironing machine, provided with means for the automatic loading of stockings oriented in a predetermined way, of a type described in the document (IT) PI/2000/A/27.

Figure 5:
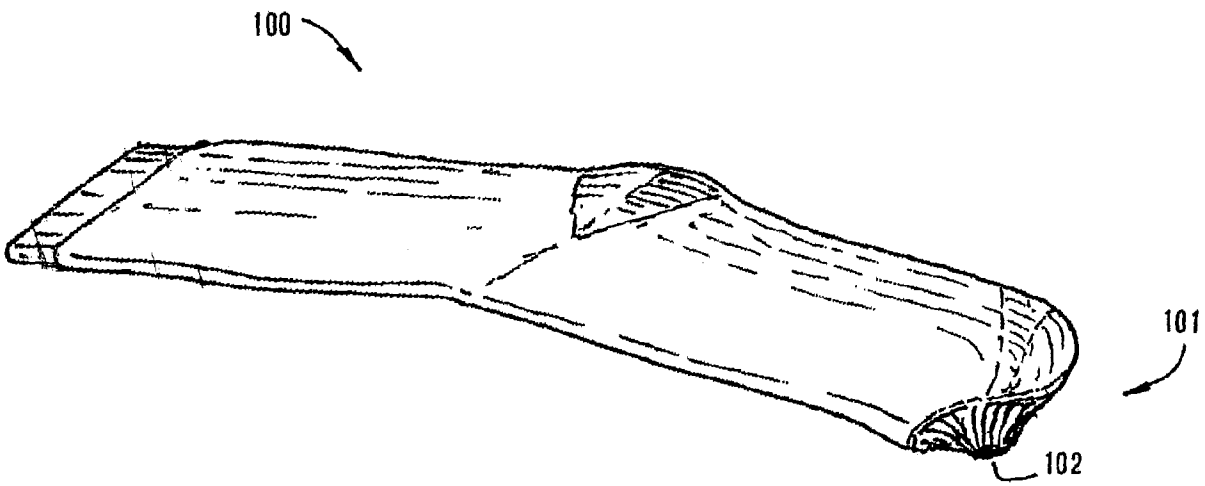
FIG. 5 shows schematically a sock with the toe still to be sewn.

The above described apparatus can be used also for the treatment of articles like stocking and socks 100 having their toe 101 still to be sewn and, more particularly, stockings and socks whose toe 101 has an aperture 102 smaller than the diameter of the pin 31. When the article 100 comes to the pin 31 with its toe forwards, the same thing occurs as has been previously described in relation to the case with closed toe, since the open toe article can not fit onto the pin—the diameter of the latter being incompatible with the aperture 102. For example, the article 100 may be knitted with a circular machine of traditional type by forming the last ranks of stitches with the use of an elastic thread which gives rise to a restricted form as shown in FIG. 5. This form is to be cut and disposed of when sewing the article's toe. The sewing and cutting steps are known to those skilled in the art and, therefore, will not be described in greater detail.

Possibly provided as a by-pass of branch 531 of circuit 5 is an outlet pipe 1000 with relevant end pot 1010 for the discharge of articles in case of an emergency such as for clearing the whole plant by removing, when necessary, all the articles present therein.

Practically, the construction details may vary in any equivalent way as far as the shape, dimensions, elements disposition, nature of the used materials are concerned, without nevertheless departing from the scope of the adopted solution idea and, thereby, remaining within the limits of the protection guard to the present patent for industrial invention. While specific embodiments of the invention have been shown and described in detail to illustrate the application of the principles of the invention, it will be understood that the invention may be embodied otherwise without departing from such principles.

What is claimed is:

1. An arrangement for detecting a longitude orientation of textile articles in a plant, the arrangement comprising:

a removal device able to pick up one article from a container in a random longitudinal orientation;

a tubular chamber with an input/output section;

a fixed pin, onto which only one end of articles may fit substantially coaxial thereto, said pin being arranged centrally within said chamber;

a detector detecting a presence of the article fitted onto said pin;

a reversing device able to reverse the orientation of the articles;

a downstream location requiring the articles in only one longitudinal orientation;

a pneumatic system moving the article from said removal device to said tubular chamber to said fixed pin, said pneumatic system selectively moving the article from said tubular chamber to either of said reversing device and said downstream location.

2. An arrangement in accordance with claim 1, wherein:

a convergent-divergent conduit is arranged between said pin and said input/output section.

3. An arrangement in accordance with claim 1, further comprising:

two photocells or groups of photocells whose optical axes are oriented towards a longitudinal axis of said chamber.

4. An arrangement in accordance with claim 1, further comprising:

rollers arranged at said input/output section of said chamber;

a measuring device connected to said rollers and able to evaluate a length of a portion of each article passing through said input/output section of said chamber.

5. An arrangement in accordance with claim 4, wherein: said measuring device measures a number of revolutions made by said rollers.

6. An arrangement in accordance with claim 4, wherein: said rollers are arranged facing each other in correspondence of said input/output section and are supported by respective arms able to change bidirectionally a distance between said rollers by passing from a stand-by configuration, in which said rollers are spaced apart, to a driving configuration, in which said rollers are in contact to each other to cause the article to transit through said input/output section.

7. An arrangement in accordance with claim 4, wherein: said rollers are slotted.

8. An arrangement in accordance with claim 1, wherein: said detector includes a plurality of photocells arranged in correspondence of said chamber and oriented towards said pin.

9. A method for detecting a longitudinal orientation of textile articles having two different sized ends, the method comprising the steps of:

providing a tubular chamber with a pin sized to fit in only one end of the textile articles;

moving each article towards the pin;

detecting in the chamber whether the article moved towards the pin fit or not onto the pin;

selectively reversing the article dependent on said detecting of the article fitting onto the pin.

10. A method according to claim 9, wherein:

said detection is carried out by an optical device oriented towards the pin.

11. A method for detecting a longitudinal orientation of an article having different size ends, the method comprising:

providing a tube with a first end and a second end;

providing a pin arranged in the second end of the tube, the pin having a size to fit in one of the ends of the article and not another end of the article;

pneumatically flowing the article through the tube in a random longitudinal orientation from said first end to said second end;

detecting if the pin has entered into a larger of the ends of the article;

if the pin has entered the larger end of the article, then moving the article from the tube to a downstream location;

if the pin has not entered the larger end of the article, then removing the article from the tube, reversing the longitudinal orientation of the article and then moving the article to the downstream location.

* * * * *